US010403969B2

(12) United States Patent
Yoon et al.

(10) Patent No.: US 10,403,969 B2
(45) Date of Patent: Sep. 3, 2019

(54) SPHERICAL MONOPOLE ANTENNA

(71) Applicants: University of Florida Research Foundation, Inc., Gainesville, FL (US); THE ATTACHED INSTITUTE OF ETRI, Yuseong-Gu, Daejeon (KR)

(72) Inventors: Yong-Kyu Yoon, Gainesville, FL (US); Cheolbok Kim, Gainesville, FL (US); Jong-Kyu Kim, Daejeon (KR)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 162 days.

(21) Appl. No.: 14/902,108

(22) PCT Filed: Jul. 3, 2014

(86) PCT No.: PCT/US2014/045357
§ 371 (c)(1),
(2) Date: Dec. 30, 2015

(87) PCT Pub. No.: WO2015/003110
PCT Pub. Date: Jan. 8, 2015

(65) Prior Publication Data

US 2016/0372823 A1 Dec. 22, 2016

Related U.S. Application Data

(60) Provisional application No. 61/842,631, filed on Jul. 3, 2013.

(51) Int. Cl.
*H01Q 1/36* (2006.01)
*H01Q 1/48* (2006.01)
(Continued)

(52) U.S. Cl.
CPC ..... *H01Q 1/36* (2013.01); *H01Q 1/48* (2013.01); *H01Q 5/25* (2015.01); *H01Q 9/40* (2013.01)

(58) Field of Classification Search
CPC .. H01Q 9/40; H01Q 1/36; H01Q 1/40; H01Q 1/48
See application file for complete search history.

(56) References Cited

U.S. PATENT DOCUMENTS 3,757,334 A 9/1973 Raabe
6,027,826 A 2/2000 deRochemont et al.
(Continued)

FOREIGN PATENT DOCUMENTS

WO 2010016799 A1 2/2010

OTHER PUBLICATIONS

Chen, et al., "A Compact Monopole Antenna for Super Wideband Applications", IEEE Antennas and Wireless Propagation Letters, vol. 10, 2011, pp. 488-491.
(Continued)

*Primary Examiner* — Daniel Munoz
(74) *Attorney, Agent, or Firm* — Thomas Horstemeyer, LLP

(57) ABSTRACT

Various examples are provided for spherical monopole antennas. In one example, among others, a spherical monopole antenna includes a spherical conductor on a first side of a substrate and a ground plane disposed on the substrate. The spherical conductor is electrically coupled to a connector via a tapered feeding line and the ground plane surrounds at least a portion of the connector on the second side of the substrate. In another example, among others, a method includes forming a tapered mold in a die layer disposed on a first side of a substrate, filling the tapered mold with a conductive paste, and disposing a spherical conductor on a
(Continued)

large end of the tapered mold. The conductive paste is in contact with a signal line extending through the substrate into a small end of the tapered mold and in contact with the spherical conductor.

20 Claims, 8 Drawing Sheets

(51) Int. Cl.
*H01Q 5/25* (2015.01)
*H01Q 9/40* (2006.01)

(56) References Cited

U.S. PATENT DOCUMENTS 6,509,880 B2 1/2003 Sabet et al.
6,812,902 B2 11/2004 Rossman et al.
6,845,253 B1 1/2005 Schantz
7,202,819 B2 4/2007 Hatch
2005/0057419 A1* 3/2005 Pintos ..... H01Q 9/40 343/816
2005/0134506 A1* 6/2005 Egbert ..... G06K 19/07749 343/700 MS
2005/0168394 A1* 8/2005 Kurashima ..... H01Q 1/38 343/780
2005/0264462 A1* 12/2005 Yanagi ..... H01Q 1/38 343/773
2006/0208953 A1* 9/2006 Shibata ..... H01Q 9/40 343/729
2007/0247371 A1 10/2007 Kunysz et al.
2012/0067871 A1* 3/2012 Sherrer ..... C23C 24/082 219/678
2012/0104573 A1 5/2012 Pagaila et al.
2013/0009851 A1 1/2013 Danesh
2013/0021207 A1* 1/2013 Lee ..... H01Q 1/38 343/700 MS
2013/0120210 A1* 5/2013 Zeiger ..... H01Q 1/3275 343/841

OTHER PUBLICATIONS

Alipour, et al., "A Novel Omni-Directional UWB Monopole Antenna", IEEE Transactions on Antennas and Propagation, vol. 56, No. 12, Dec. 2008, pp. 3854-3857.
Kim, et al., "Computer-Controlled Dynamic Mode Multidirectional UV Lithography for 3D Microfabrication", IOP Publishing, Journal of Micromechanics and Miroengineering, 21, 2011, 14 pages.
International Search Report for PCT/US2014/045357 dated Nov. 7, 2014.
Hosseini et al., Study of an UW8 Spherical Monopole Antenna on the Dielectric Substrate, International Journal of Computer and Electrical Engineering, vol. 4, No. 6, Dec. 2012, [Retrieved on line Oct. 1, 2014 (Oct. 1, 2014 )], Retrieved from URL: http://www.ijcee.org/papers/635-X1242.pdf].
Liang, "Ultra-Wideband Antenna and Design", ISBN 978-953-51-0781-1, Published on Oct. 3, 2012, Chapter 7, pp. 127-152.
AET: Applied Electromagnetic Technology, LLC.—Options, http://www.appliedemtech.com/psdstripodadapter.html, available since 2001.
MDL Technologies, http://www.mdltechnologies.co.uk/product/universal-spherical-dipole-source/, available since 2001.

* cited by examiner

SPHERICAL MONOPOLE ANTENNA

CROSS REFERENCE TO RELATED APPLICATIONS

This application is the 35 U.S.C. § 371 national stage application of PCT Application No. PCT/US2014/045357, filed Jul. 3, 2014, which claims priority to U.S. provisional application entitled "SPHERICAL MONOPOLE ANTENNA" having Ser. No. 61/842,631, filed Jul. 3, 2013, the entirety of which are hereby incorporated by reference.

BACKGROUND

Ultra-wideband (UWB) is a technology for transmitting data over a large bandwidth greater than 500 MHz. Super-wideband (SWB) is one providing at least a bandwidth ratio of 10:1 for high-resolution. UWB and SWB are used for high-data-rate wireless communication, long-range radar and imaging systems. UWB/SWB antennas are key components for such wireless communication, radar, and imaging systems. Antenna characteristics include input impedance, radiation pattern, gain, efficiency, etc. Because of their use in portable wireless devices, the antenna designs are affected by many factors such as space limitations, geometry, multi antenna interference, etc.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
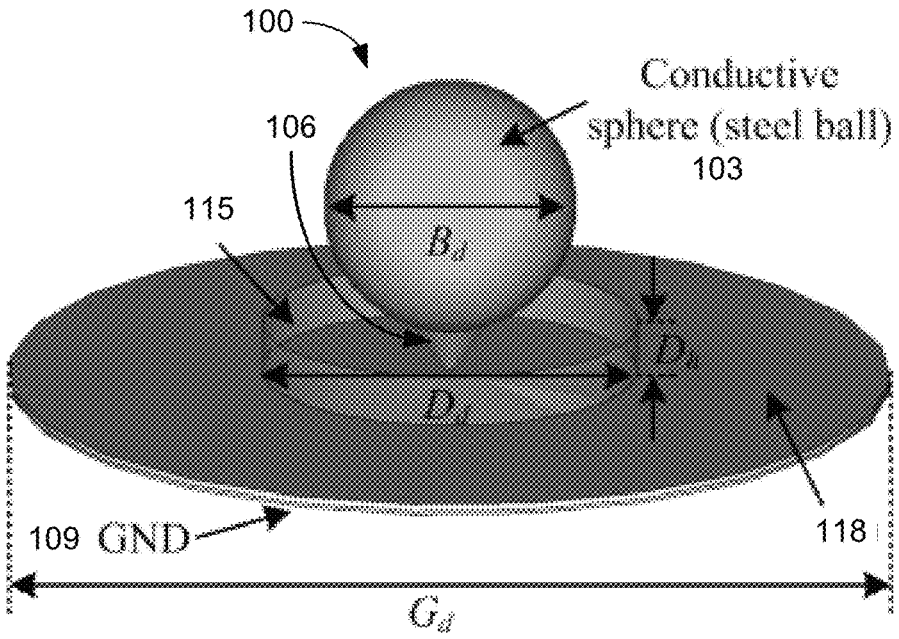
FIGS. 1A and 1B are examples of perspective and cross-sectional views, respectively, of a spherical super wideband (SWB) antenna in accordance with various embodiments of the present disclosure.

Disclosed herein are various examples related to embodiments of spherical monopole antennas. In this disclosure, the design, fabrication, and characterization of spherical monopole antennas using a super wideband technique with a tapered feeding line is discussed. Reference will now be made in detail to the description of the embodiments as illustrated in the drawings, wherein like reference numbers indicate like parts throughout the several views.

Using a super wideband (SWB) technique can provide at least a ratio bandwidth of 10:1 for high-resolution sensing through, e.g., wall radar and surveillance systems. The extremely wide bandwidth may be achieved by accommodating smooth antenna geometries such as, e.g., a tapered feed line, a rounded ground plane and/or a circular/elliptical patch. While showing good bandwidth performance, planar monopole antennas can suffer from substrate dielectric loss and distortion in the omni-directional radiation pattern. Three dimensional (3D) SWB antennas can provide better omni-directionality.

A 3D SWB monopole antenna such as, e.g., a spherical SWB antenna can be designed, fabricated and characterized as will be described. For example, a separate conductive sphere (e.g., a steel ball) may be adopted as a main radiator. A 3D tapered feeding line can be implemented by, e.g., a layer of photopatternable polyurethane (e.g., D50, MacDermid Inc. or other appropriate patternable material), multidirectional ultraviolet (UV) lithography, and molded conductive paste.

The low frequency cutoff of the spherical SWB antenna may be mainly determined by the diameter of the conductive sphere of the spherical SWB antenna at its quarter wavelength, where the conductive sphere serves as a main radiator. The upper cutoff can be greatly enlarged by using a tapered feeding line between a coaxial connection and the conductive sphere, which can be fabricated using thick photopatternable polyurethane (e.g., D50, MacDermid Inc.) and 3D multidirectional UV lithography. In some implementations, the spherical SWB antenna can have a 10 dB bandwidth between about 2.4 GHz and about 23.2 GHz (a ratio bandwidth of 9.7:1), and an omni-directional radiation pattern with a maximum gain of approximately 2.9 dBi at 10 GHz.

Antenna Configuration

Figure 1B:
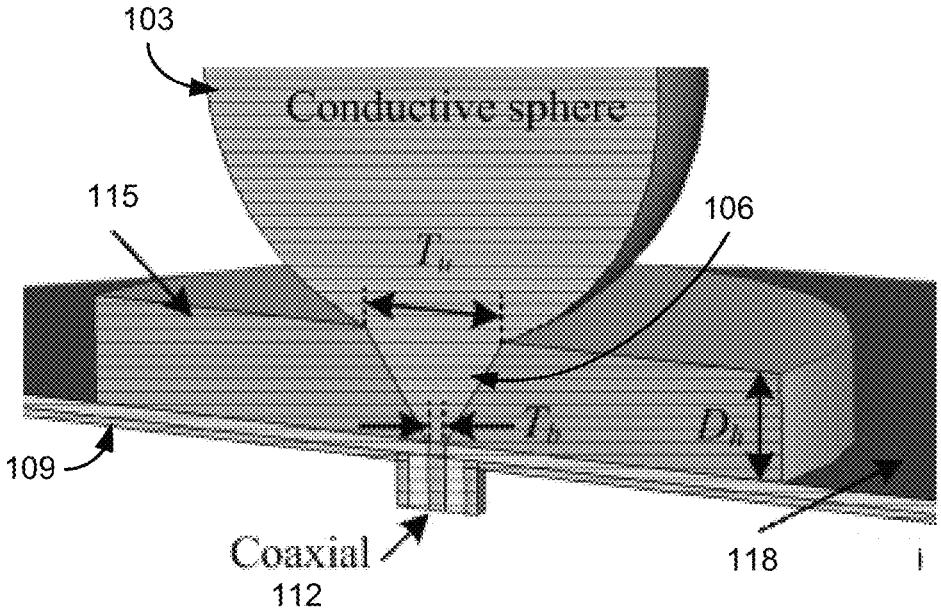

Referring to FIGS. 1A and 1B, shown are perspective and cross-sectional views, respectively, of an example of a spherical SWB antenna 100. In the example of FIG. 1, the spherical SWB antenna 100 includes a conductive sphere 103, a tapered feeding line 106, and a circular ground plane 109. In some embodiments, the conductive sphere 103 can be, e.g., a steel ball, copper ball, or other appropriate hollow conductive shell or solid conductive ball. As shown in the cross-sectional view of FIG. 1B, the tapered feeding line 106 electrically couples the conductive sphere 103 and a coaxial connection 112 that extends through the ground plane 109. In the example of FIGS. 1A and 1B, a patternable die layer 115 such as, e.g., a photopatternable polyurethane (PU) layer surrounds the tapered feeding line 106. The patternable die layer 115 may be circular or other appropriate geometrical pattern such as, e.g., a polygon. As illustrated in FIGS. 1A and 1B, the circular ground plane may be located underneath a laminate layer 118 of, e.g., a printed circuit board (PCB). For example, the laminate layer (or substrate) 118 may be a layer of polytetrafluoroethylene (PTFE) such as, e.g., RT-duroid 5880LZ. The ground plane 109 is located on a side of the laminate layer 118 opposite the conductive sphere 103 and tapered feeding line 106 as shown in FIG. 1B. The geometry of the ground plane 109 may be, e.g., circular, hexagonal, octagonal, or other appropriate pattern.

The height of the spherical SWB antenna 100 is approximately the sum of the ball (or sphere) diameter ($B_d$) and the height of the die layer 115 ($D_h$), which determines the lowest resonant frequency corresponding to approximately a quarter wavelength at the lowest frequency. The operating bandwidth of the spherical SWB antenna 100 depends on the dimensions of the tapered feeding line 106. Dimensions of the spherical SWB antenna 100 can be designed and optimized using a commercial 3D electromagnetic simulator such as, e.g., CST Microwave Studio or ANSYS High Frequency Structure Simulator.

An example of a spherical SWB antenna 100 was implemented to test the operational characteristics. The geometry of the fabricated spherical SWB antenna 100 of FIGS. 1A and 1B can be: ball diameter $B_d$=24 mm of the conductive sphere 103; diameter $D_d$=30 mm of the die layer 115; height $D_h$=5 mm of the die layer 115; diameter $G_d$=70 mm of the circular ground plane 109; upper diameter $T_u$=6 mm of the tapered feeding line 106; and bottom diameter $T_b$=1 mm of the tapered feeding line 106. The laminate layer 118 is RT-duroid 5880LZ ($\varepsilon_r$=1.96) with a thickness of 0.508 mm. Other thicknesses of the laminate layer 118 may be used.

Figure 2:
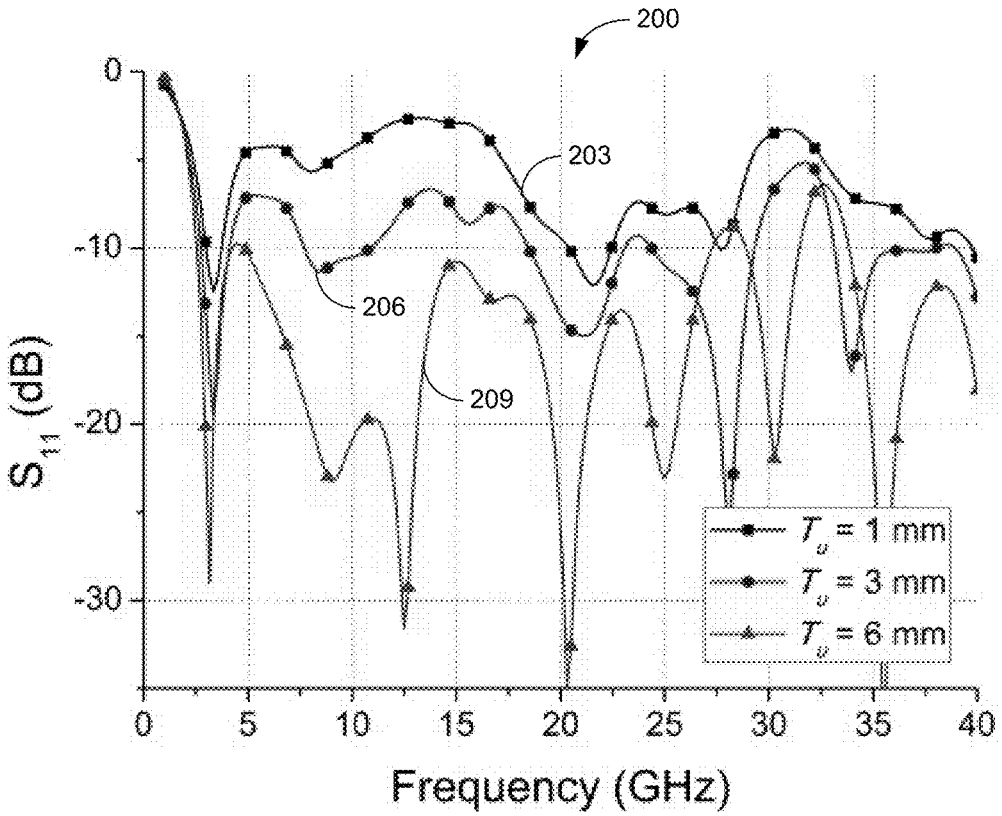
FIG. 2 is a plot of an example of return loss of a spherical SWB antenna of FIGS. 1A and 1B in accordance with various embodiments of the present disclosure.

FIG. 2 is a plot 200 illustrating the effect on the return loss for variations in the upper diameter $T_u$ of the tapered feeding line 106. FIG. 2 provides simulated results for upper diameters of $T_u$=1 mm (curve 203), $T_u$=3 mm (curve 206), and $T_u$=6 mm (curve 209). The bottom diameter of the tapered feeding line 106 remained constant at $T_b$=1 mm.

Figure 3A:
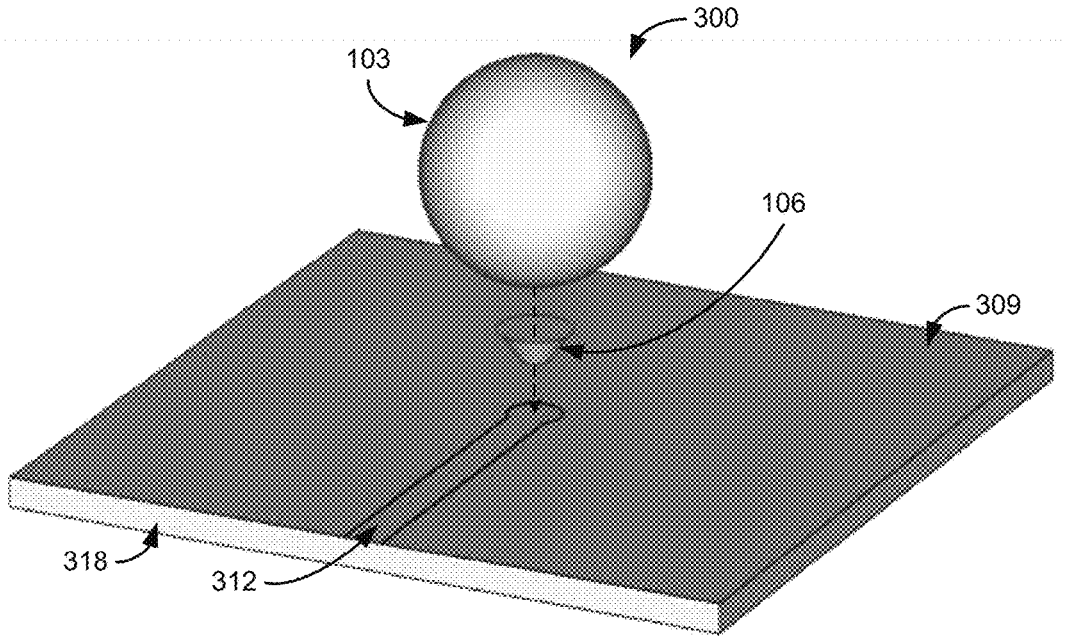
FIGS. 3A and 3B are graphical representations of examples of a spherical SWB antenna including coplanar waveguide feeding in accordance with various embodiments of the present disclosure.
Figure 3B:
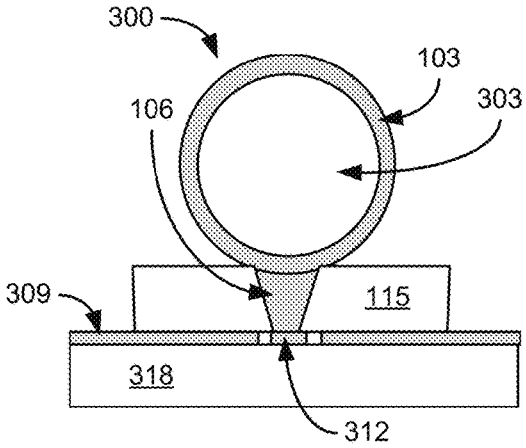

Referring to FIGS. 3A and 3B, shown is an example of a spherical SWB antenna 300 including coplanar waveguide feeding. FIG. 3A is an exploded view illustrating the relationship between the conductive sphere 103, the tapered feeding line 106 and a coplanar waveguide 312 located on a side of a substrate 318 adjacent to the conductive sphere 103. FIG. 3B provides a cross-sectional view of the spherical SWB antenna 300 including coplanar waveguide feeding. The spherical SWB antenna 300 includes a conductive sphere 103 coupled to a coplanar waveguide 312 via a tapered feeding line 106. In the example of FIGS. 3A and 3B, the coplanar waveguide 312 and a ground plane 309 are disposed on the same side of the substrate 318 as the conductive sphere 103 and the tapered feeding line 106. In other implementations, the coplanar waveguide 312 and ground plane 309 may be disposed on the side of the substrate 318 that is opposite the conductive sphere 103 and the tapered feeding line 106.

In some embodiments, the conductive sphere 103 can be, e.g., a steel ball, copper ball, or other appropriate hollow conductive shell or solid conductive ball. In the example of FIG. 1B, the conductive sphere 103 includes a hollow conductive shell with a central void 303 that may be filled with air, a dielectric, a polymer (e.g., Styrofoam), a metal, or other appropriate material. The thickness of the hollow conductive shell may be, e.g., about 10 μm to about 20 μm thick for use at about 1 GHz. The tapered feeding line 106 electrically couples the conductive sphere 103 and the coplanar waveguide 312 that extends through the ground plane 309 as shown in FIG. 3A. When the coplanar waveguide 312 and ground plane 309 are disposed on the side of the substrate 318 that is opposite the conductive sphere 103 and the tapered feeding line 106, a via (or other appropriate connection) that extends through the substrate may be used to couple the tapered feeding line 106 to the coplanar waveguide 312. As illustrated in FIG. 3B, a patternable die layer 115 such as, e.g., a photopatternable polyurethane (PU) layer surrounds the tapered feeding line 106.

Antenna Fabrication

Figure 4:
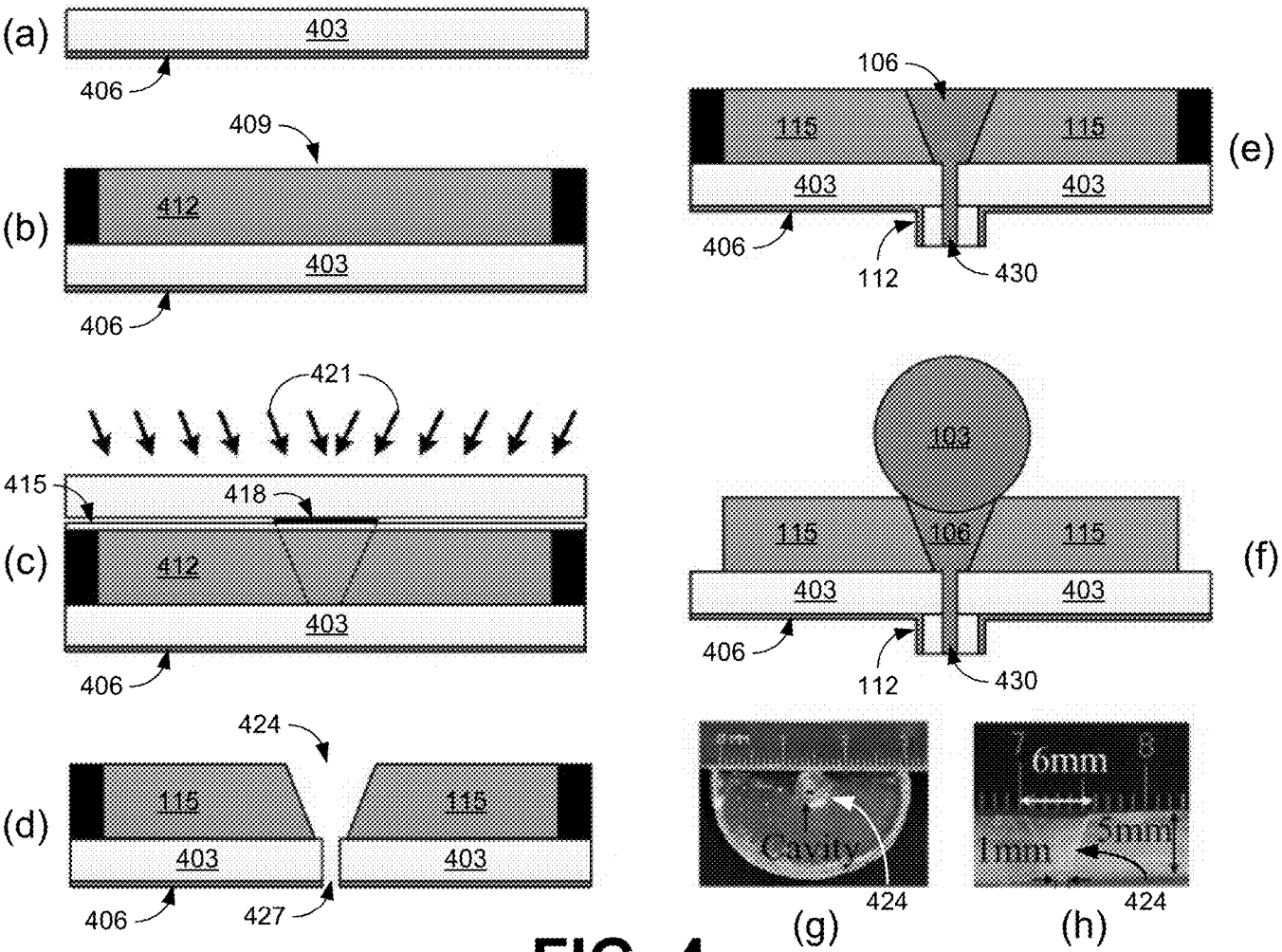
FIG. 4 is a graphical representation illustrating an example of a fabrication process of a spherical SWB antenna of FIGS. 1A and 1B in accordance with various embodiments of the present disclosure.

Referring to FIG. 4, shown is an example of fabrication of a spherical SWB antenna 100 of FIGS. 1A and 1B with a tapered feeding line 106 using micro-fabrication processes. The process begins with a substrate 403 (e.g., a planar substrate) clad on a single side with copper 406 in FIG. 4(*a*). A circular ground plane 109 may be formed in the copper layer 406. On the single side copper clad substrate 403, a circular cavity 409 having a diameter $D_d$ and height $D_h$ for the die layer 115 is defined on a side of the substrate 403 opposite the copper 406 in FIG. 4(*b*) and a liquid-state negative photopatternable PU 412 (e.g., D50 or other appropriate patternable material) is poured into the circular cavity 409. In FIG. 4(*c*), a photomask 415 is placed over the photopatternable PU 412 with a thin protection film 418 placed on top. Lithographic exposure using 3D multidirectional UV radiation 421 is performed to crosslink the liquid-state negative photopatternable PU 412. The direction of the UV radiation 421 forms a tapered mold 424 in the die layer 115 for the tapered feeding line 106. For example, unexposed D50 can be washed away in water to form the tapered mold 424 and a feeding hole 427 may then be drilled through the substrate 403 (e.g., using a CNC (computer numerical controlled) lathe) as shown in FIG. 4(*d*).

Figure 5:
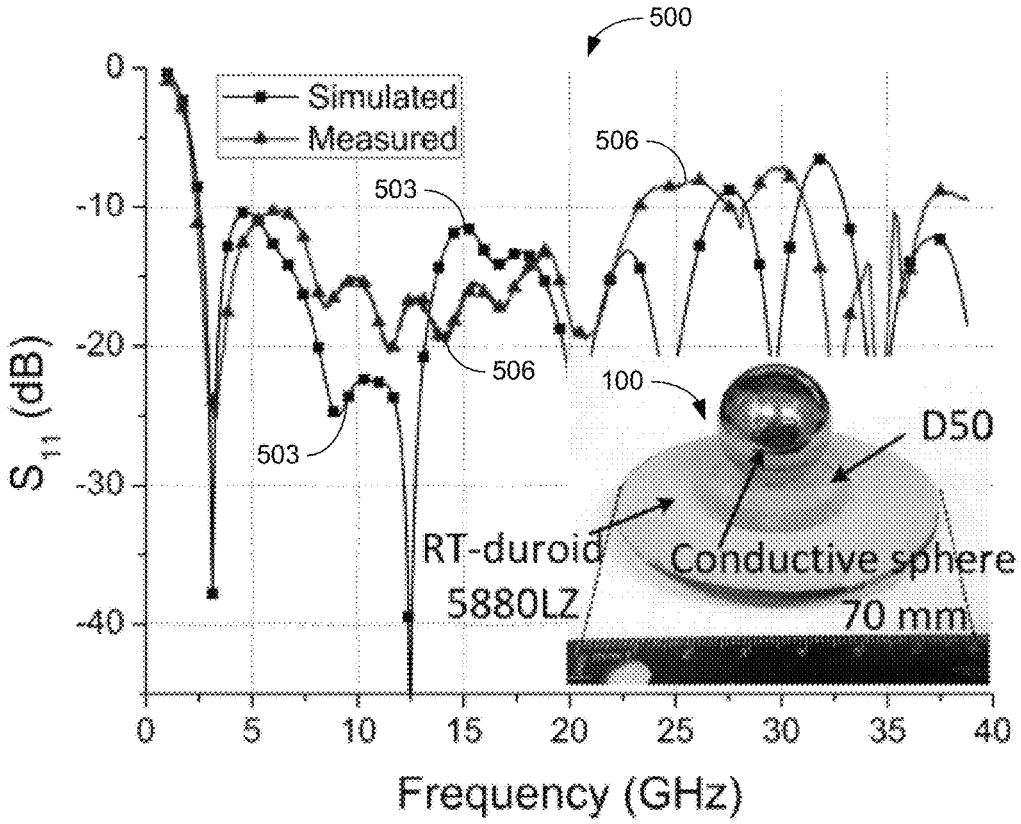
FIG. 5 is a plot of an example of return loss of a fabricated spherical SWB antenna of FIGS. 1A and 1B in accordance with various embodiments of the present disclosure.
Figure 6A:
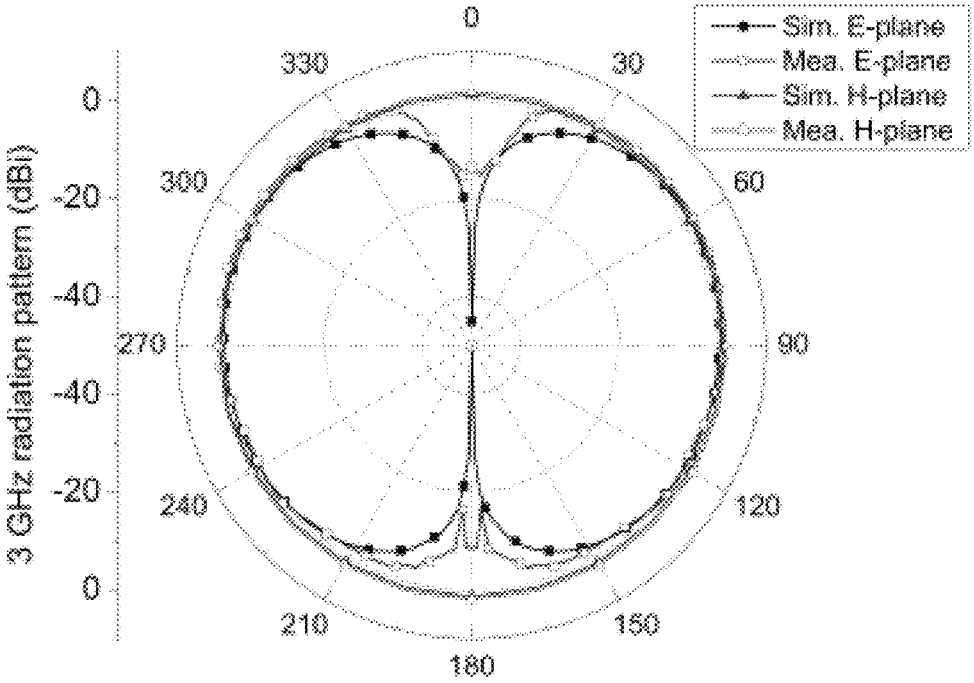
FIGS. 6A-6D are plots of examples of radiation patterns of the fabricated spherical SWB antenna of FIGS. 1A and 1B in accordance with various embodiments of the present disclosure.
Figure 6B:
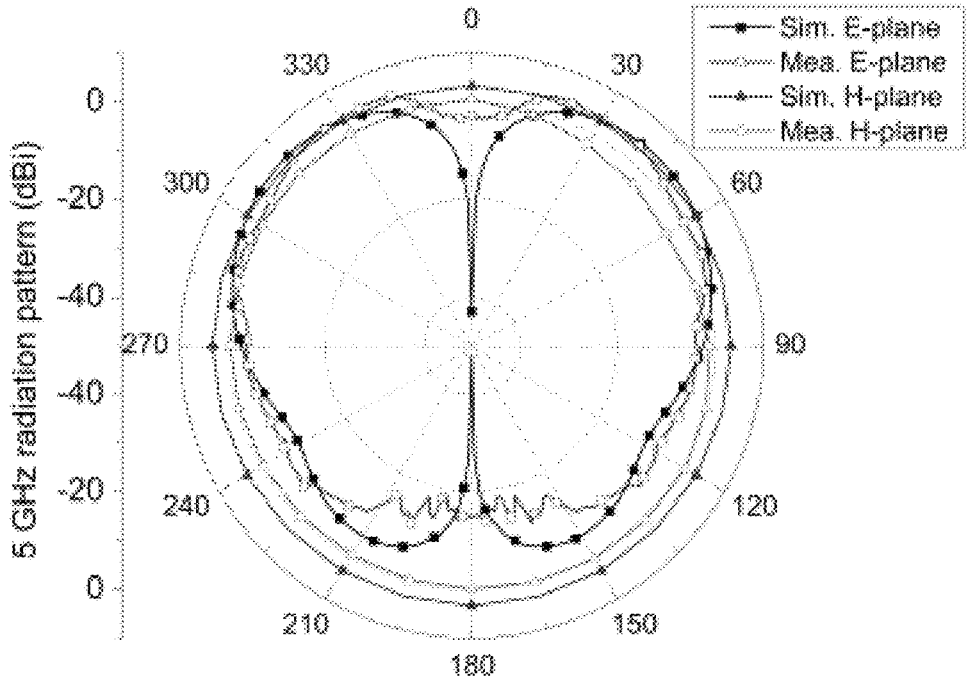
Figure 6C:
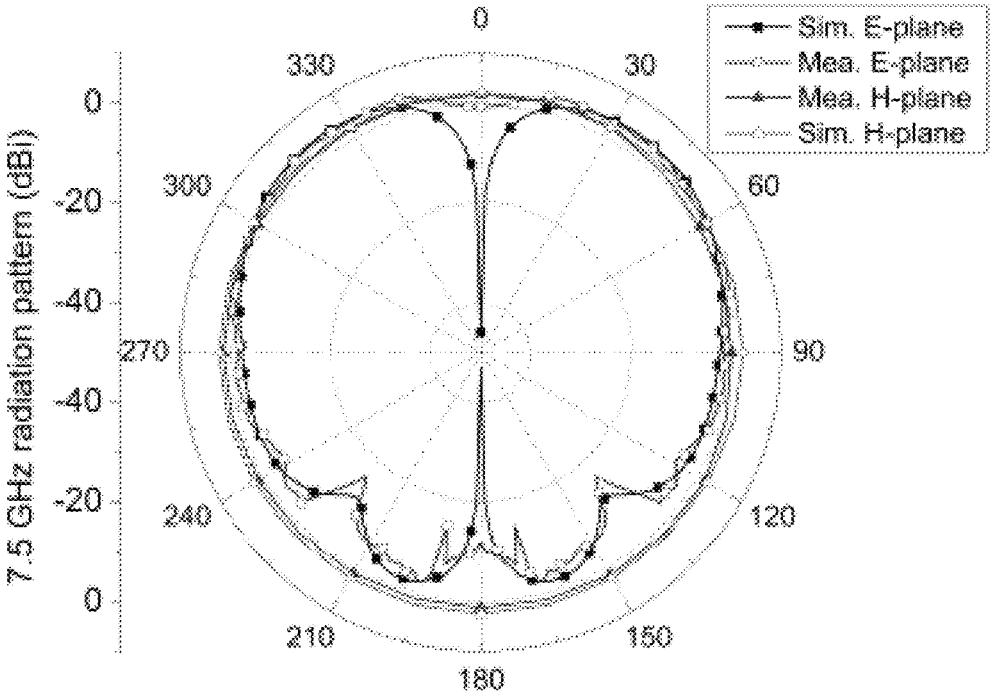
Figure 6D:
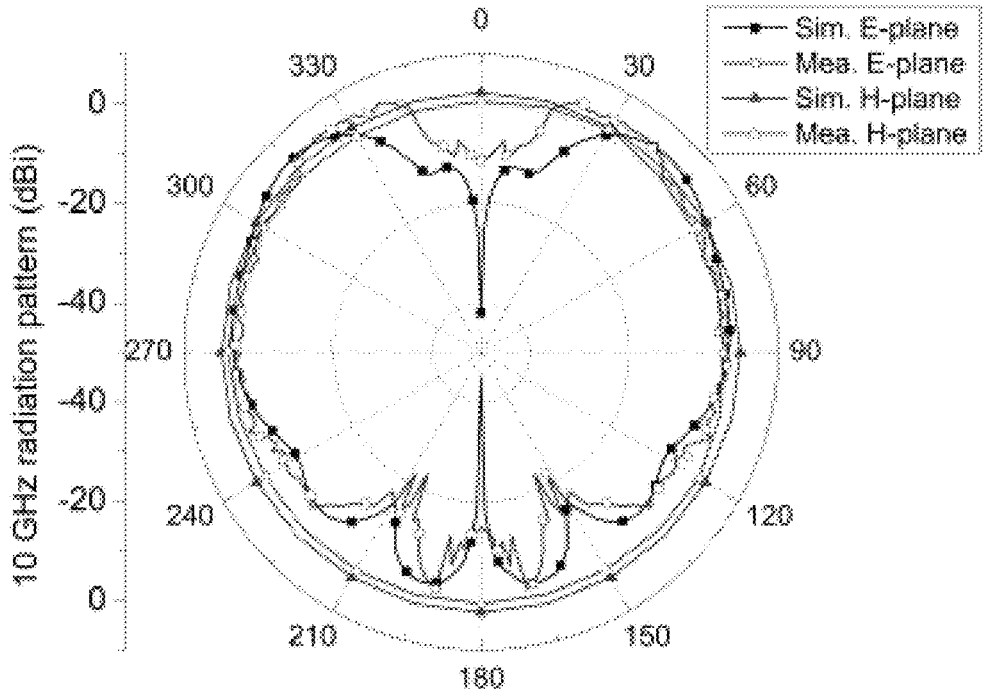

Moving to FIG. 4(*e*), the tapered mold 424 is filled with conductive paste (e.g., a gel-state silver paste), followed by assembling a coaxial connection 112 such as, e.g., a SMA (SubMiniature version A) connector through the feeding hole 427. In this way, the signal line 430 of the coaxial connection 112 is electrically connected to the tapered feeding line 106. A second connection of the coaxial connection can be coupled to the copper layer 406. After removing the form from around the circular cavity 409 and placing the conductive sphere 103 on the conductive paste filled tapered feeding cavity 424 in FIG. 4(*f*), the spherical SWB antenna 100 can be left at the room temperature for about 12 hours to solidify the conductive paste and complete the electrical connection with the conductive sphere 103. Other methods for solidifying the conductive paste may also be utilized to secure the conductive sphere 103 and/or signal line 430 in position. FIGS. 4(*g*) and (*h*) show perspective and cross sectional views of the fabricated tapered mold 424 in a die layer 115 of D50. FIG. 5 includes an image of a fabricated spherical SWB antenna 100.

The spherical SWB antenna 300 of FIGS. 3A and 3B, including coplanar waveguide feeding, may be fabricated in a similar fashion. The coplanar waveguide 312 and the ground plane 309 may be formed on a side of the substrate 318. A cavity may be defined over the coplanar waveguide 312 and the ground plane 309 and a liquid-state negative photopatternable PU (e.g., D50 or other appropriate patternable material) can be poured into the cavity. The cavity may be on the same side of the substrate 318 or the opposite side of the substrate 318 as the coplanar waveguide 312 and ground plane 309. A photomask is placed over the photopatternable PU with a thin protection film placed on top. Lithographic exposure using 3D multidirectional UV radiation is performed to crosslink the liquid-state negative photopatternable PU and form a tapered mold in the die layer 115 for the tapered feeding line 106. The tapered mold extends through the die layer 115 providing access to a contact area of the coplanar waveguide 312. The tapered mold may be filled with conductive paste (e.g., a gel-state silver paste) to form the tapered feeding line 106, which is electrically connected to the coplanar waveguide 312. The contact area may be at the end of the coplanar waveguide 312 and, in some implementations, may extend through the substrate 318. For example, the contact area may include a via that extends through the substrate 318 from an end of the coplanar waveguide 312 for connection with the tapered feeding line 106. The conductive sphere 103 may then be disposed on the conductive paste filled tapered feeding cavity and the conductive paste allowed to solidify to complete the electrical connection with the conductive sphere 103.

Test Results

The fabricated spherical SWB antenna 100 of FIG. 5 was characterized using a vector network analyzer (HP E8361A) after one port calibration from 1 to 40 GHz and standard horn antenna (JXTXLB-10180, AINFO Inc.). FIG. 5 shows a plot 500 of the simulated and measured return loss of the fabricated spherical SWB antenna 100 as curves 503 and 506, respectively. The simulated and measured 10 dB-bandwidths of the antenna were 166% (2.5 GHz-26.8 GHz, 10.7:1 ratio bandwidth) and 163% (2.45 GHz-23.2 GHz, 9.7:1 ratio bandwidth), respectively. The slight deviation between the measured bandwidth and the simulated one may be due to the fabrication tolerance.

Referring to FIGS. 6A-6D, shown are the simulated and measured radiation patterns at 3 GHz, 5 GHz, 7.5 GHz and 10 GHz, respectively. The plots of FIGS. 6A-6D include simulated and measured radiation patterns in both the E-plane and H-plane. FIGS. 6A-6D illustrate monopole-like radiation patterns at each frequency for the spherical SWB antenna 100. Also, FIGS. 6A-6D show good omni-directional radiation patterns.

Figure 7:
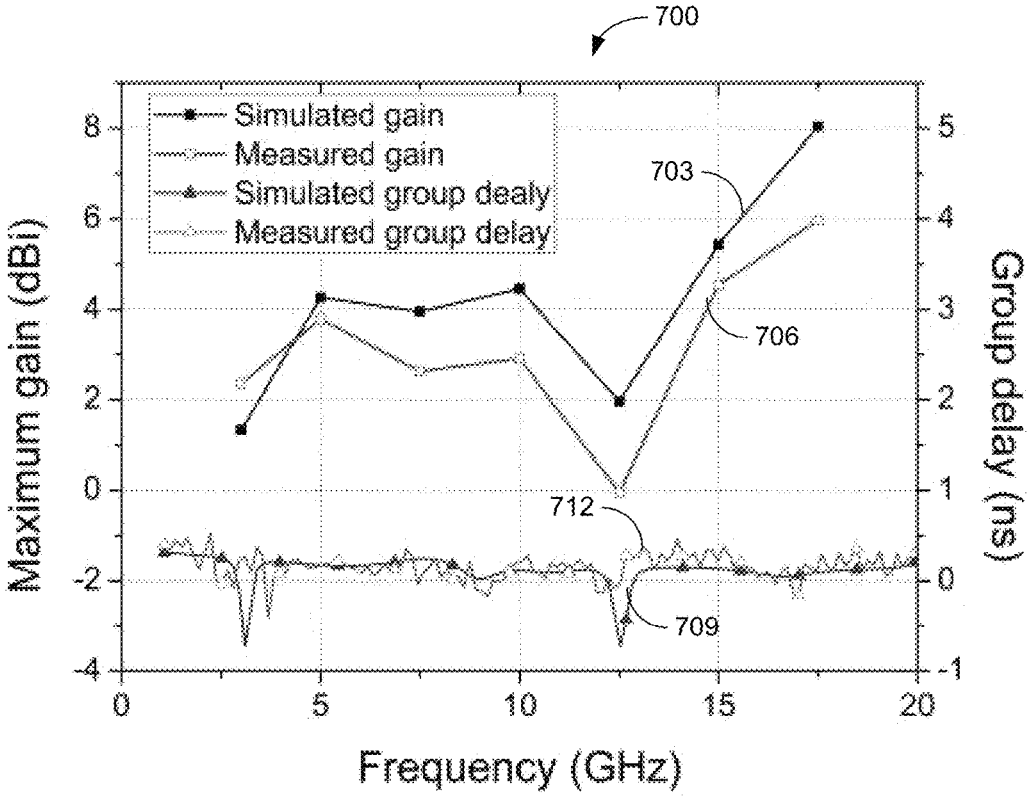
FIG. 7 is a plot of examples of gain and group delay of the fabricated spherical SWB antenna of FIGS. 1A and 1B in accordance with various embodiments of the present disclosure.

Referring next to FIG. 7, shown is a plot 700 of the simulated and measured maximum gain (curves 703 and 706, respectively) and group delay (curves 709 and 712, respectively). Although there is a small discrepancy between the simulated and measured maximum gain and group delay, they show similar trends. The decreased gain at 12 GHz may be attributed to the contribution of self-resonance of the D50 layer with a finite size. Changing the dimension of the die layer 112 may alleviate this. The simulated and measured group delay (curves 709 and 712, respectively) of the spherical SWB antenna 100 is less than ±1 ns, which is excellent for pulse communication.

A 3D spherical SWB antenna 100 was designed, fabricated and characterized. As seen by FIGS. 5, 6A-6D, and 7 measured results were well matched with the simulated results. The spherical SWB antenna 100 has a 10 dB-bandwidth of 163% (ratio bandwidth of 9.7:1) and a maximum gain of about 2.9 dBi at 10 GHz. The spherical SWB antenna 100 exhibits good manufacturability, low cost, and a good omni-directional radiation pattern. Also, the lowest resonant frequency is easily tunable by assembling a different size of conductive sphere 103, and therefore the design and process can be scalable.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A spherical monopole antenna, comprising:

a spherical conductor on a first side of a substrate, the spherical conductor electrically coupled to a connector via a tapered feeding line surrounded by a photopatternable die layer patternable by ultraviolet (UV) lithography, the photopatternable die layer located between the first side of the substrate and the spherical conductor, wherein a large end of the tapered feeding line is electrically coupled to the spherical conductor and surrounded by the photopatternable die layer, and a small end of the tapered feeding line is electrically coupled to the connector adjacent to the first side of the substrate, wherein a combined height of the photopatternable die layer and the spherical conductor disposed on the photopatternable die layer is approximately a quarter wavelength of a lowest operating frequency of the spherical monopole antenna; and a ground plane disposed on the substrate, the ground plane surrounding at least a portion of the connector.

2. The spherical monopole antenna of claim 1, wherein the connector comprises a connection that extends through the substrate from a second side of the substrate to the tapered feeding line and the ground plane is disposed on the second side of the substrate.

3. The spherical monopole antenna of claim 2, wherein the ground plane is a circular ground plane centered about the tapered feeding line.

4. The spherical monopole antenna of claim 2, wherein the connector is a coplanar waveguide that is electrically coupled at the small end of the tapered feeding line.

5. The spherical monopole antenna of claim 1, wherein the tapered feeding line is electrically coupled to a signal line of the connector at the small end adjacent to the first side of the substrate.

6. The spherical monopole antenna of claim 1, wherein the connector is a coaxial connector comprising a first center connection electrically coupled to the small end of the tapered feeding line and a second outer connection electrically coupled to the ground plane on a second side of the substrate, wherein the ground plane is between the coaxial connector and the spherical conductor.

7. The spherical monopole antenna of claim 1, wherein the connector is on the first side of the substrate and the ground plane is disposed on the first side of the substrate.

8. The spherical monopole antenna of claim 1, wherein the connector is a coplanar waveguide that is electrically coupled at the small end of the tapered feeding line.

9. The spherical monopole antenna of claim 1, wherein the photopatternable die layer is disposed on the first side of the substrate and comprises a tapered mold in which the tapered feeding line is disposed.

10. The spherical monopole antenna of claim 9, wherein the photopatternable die layer is centered about the tapered feeding line.

11. The spherical monopole antenna of claim 9, wherein the spherical conductor is disposed on a first surface of the photopatternable die layer that is opposite the first side of the substrate.

12. The spherical monopole antenna of claim 1, wherein the spherical conductor comprises a void within a conductive shell.

13. The spherical monopole antenna of claim 12, wherein the void is filled with a polymer.

14. The spherical monopole antenna of claim 1, wherein the photopatternable die layer comprises a photopatternable polyurethane layer.

15. The spherical monopole antenna of claim 14, wherein the tapered feeding line is disposed in a tapered mold having an angle formed by multidirectional lithographic exposure of a photomask over the photopatternable polyurethane layer.

16. The spherical monopole antenna of claim 1, wherein the connector is a coplanar waveguide that is electrically coupled at the small end of the tapered feeding line, wherein the coplanar waveguide and the ground plane are disposed on the first side of the substrate.

17. The spherical monopole antenna of claim 1, wherein the connector is a coplanar waveguide that is electrically coupled to the small end of the tapered feeding line, wherein the coplanar waveguide and the ground plane are disposed on the second side of the substrate.

18. The spherical monopole antenna of claim 1, wherein the connector is a coaxial connector with a second connection electrically coupled to the ground plane on a second side of the substrate, wherein a central conductor of the coaxial connector extends through the ground plane.

19. The spherical monopole antenna of claim 1, further comprises a polytetrafluoroethylene layer that is positioned on top of the ground plane.

20. The spherical monopole antenna of claim 1, wherein a height of the photopatternable die layer is about 5 mm.

* * * * *